US007585003B2

(12) United States Patent
Lee

(10) Patent No.: US 7,585,003 B2
(45) Date of Patent: Sep. 8, 2009

(54) APPARATUS FOR ADJUSTING THE LENGTH OF A THREAD LOOP IN A TAG FASTENER

(76) Inventor: Duk-Hee Lee, 205-6, Umyeon-dong, Seocho-gu, Seoul (KR) 137-901

( * ) Notice: Subject to any disclaimer, the term of this patent is extended or adjusted under 35 U.S.C. 154(b) by 0 days.

(21) Appl. No.: 12/055,652

(22) Filed: Mar. 26, 2008

(65) Prior Publication Data

US 2008/0238097 A1 Oct. 2, 2008

(30) Foreign Application Priority Data

Mar. 29, 2007 (KR) ..... 10-2007-0030599

(51) Int. Cl.
*B65H 69/04* (2006.01)

(52) U.S. Cl. ..... 289/16

(58) Field of Classification Search ..... 289/16, 289/17; 227/67

See application file for complete search history.

(56) References Cited

U.S. PATENT DOCUMENTS 5,322,203 A * 6/1994 Vickery ..... 227/67
5,497,930 A * 3/1996 Kubota ..... 227/67
6,065,661 A * 5/2000 Kunreuther et al. ..... 227/67
6,364,191 B1 * 4/2002 Deschenes et al. ..... 227/67
6,685,077 B1 * 2/2004 Davignon et al. ..... 227/67

* cited by examiner

*Primary Examiner*—Shaun R Hurley
(74) *Attorney, Agent, or Firm*—King & Schickli, PLLC

(57) ABSTRACT

In a tag fastener for fastening a tag by looping and knotting a thread, an apparatus for adjusting the length of a thread loop is provided at the forefront portion of the body (1) having a front cover plate (2) supporting a needle (1*n*) and capable of being opened and closed, with a thread hanging bar (3) being translatable between an upper step and a lower step position through a displacement lever (3*v*). As the position of the thread hanging bar (3) can be variably adjusted between upper and lower step positions, the length of the loop for attaching a tag can be adjusted as desired. Further, as the front cover plate (2) can be opened, it is easy to clean the inside of the front cover plate and the tag fastener can be used more conveniently.

5 Claims, 3 Drawing Sheets

APPARATUS FOR ADJUSTING THE LENGTH OF A THREAD LOOP IN A TAG FASTENER

TECHNICAL FIELD

The present invention relates to an apparatus for adjusting the length of a thread loop in a tag fastener.

BACKGROUND OF THE INVENTION

Tagging apparatuses have been known, such as a tag gun for fastening a price tag on various products using a plastic pin and a tag fastener for fastening a tag with a thread being supplied through a needle, looping the thread and knotting the loop at the end of the loop.

The conventional tag fastener related to the present invention is provided with a needle-mounted front cover plate integrally formed with the side plates of the body of the tag fastener, making it impossible to open the front of the body. Therefore, the waste threads sticking to the inside of the body had to be cleaned through the narrow waste thread releasing outlet at the bottom of the body, causing inconvenience in cleaning because of the various components in the body, such as a rotating shaft, causing obstacles to the cleaning work.

Moreover, as the thread hanging bar holding the loop for fastening a tag is mounted in a fixed position closely from the needle in the front of the body, the interval between the thread hanging bar and the knotter mounted in the body is invariable, therefore, the tag fastener can produce only one fixed length of a loop. This was a problem and left a lot of room for improvement.

SUMMARY OF THE INVENTION

To rectify the above-noted problem in the conventional art, the present invention provides a tag fastener for fastening a tag on a product by looping and knotting a thread, the tag fastener having a body wherein the forefront portion of the body is formed with an opening between the two side plates of the body and a needle-supporting front cover plate is mounted in said opening via hinge pins in such a way that it can be opened and closed vertically.

A displacement lever is mounted on a side in the middle portion of the needle-supporting front cover plate, and a thread hanging bar is mounted at one end of said displacement lever in such a way that the thread hanging bar crosses the slit in the needle-supporting front cover plate, and the bended end of the thread hanging bar is inserted optionally into an upper stay hole or a lower stay hole formed on a side of the needle-supporting front cover plate so that the thread hanging bar may be placed firmly in an upper step position or in a lower step position.

Because the needle-supporting front cover plate is mounted at the front of the body of the tag fastener in such a way that the needle-supporting front cover plate can be opened and closed, if the inside of the body is to be cleaned, the needle-supporting front cover plate is lifted open to open the front portion of the body and then the dusts and waste threads sticking to the inside of the body can be conveniently and easily cleaned through the opened front of the body. Therefore, the problem of inconvenience in cleaning the inside of the body only through the waste thread releasing outlet is resolved, preventing the derangement of the operation of the tag fastener caused by the dust and waste threads stuck on the gears and other components in the body.

In addition, as the thread hanging bar is mounted in such a way as to be variably positioned in an upper step or in a lower step position, if a tag is fastened with the thread hanging bar positioned at a lower step, the distance between the thread hanging bar and the knotter in the tag fastener is shortened and when the thread supplied to the needle is pulled by a hook in the body and received by the thread hanging bar and supplied to the knotter, the thread loop is formed with a length commensurate with the distance between the thread hanging bar and the knotter.

Likewise, if a tag is fastened with the thread hanging bar positioned in an upper step, the distance between the thread hanging bar and the knotter becomes longer, and a longer loop is formed commensurate with the distance between the thread hanging bar and the knotter.

Furthermore, if the displacement lever of the thread hanging bar is turned upwards to the upper step or downward to the lower step and the hook formed at the end of the thread hanging bar is inserted into the stay hole (fu, fb) formed on a side of the needle-supporting front cover plate, the thread hanging bar stays stably in its fixed position when a tag is being fastened, enabling the tag fastener fasten a tag safely.

Furthermore, as the construction of the position-varying thread hanging bar is so simple, its production is easy and there is little likelihood of the device going out of order. Therefore, the apparatus for adjusting the length of a thread loop in the present invention capable of selectively varying the length of the loop can be used more conveniently than the conventional tag guns or tag fasteners.

NUMERALS OF IMPORTANT PARTS IN THE DRAWINGS

1: body (of a tag fastener), 2: needle-supporting front cover plate, 2*s* : hinge pin, 2*s*': buckle bolt, 2*g*: buckle groove, 3: thread hanging bar, 3*e* : bended end, 3*v*: displacement lever, fu, fb: stay hole.

DETAILED DESCRIPTION OF THE INVENTION

As shown in FIG. 1 through FIG. 4, the forefront portion of the body of the tag fastener for fastening a tag by looping and knotting a thread is formed in such a way that it is left open in a predetermined width by both side plates (1*a*) of the body (1) and a stay bolt (1*b*). Into the open forefront, the inserting flanges (2*f*), which are formed at the inner portion of the rectangular needle-supporting front cover plate (2) from which a needle (1*n*) protrudes, are inserted into the inside of the side plates (1*a*) on both sides of the body (1), and hinge pins (2*s*) are mounted through the side plates (1*a*) into the upper end portion of the flanges (2*f*) so that the needle-supporting front cover plate may be opened up and closed down.

Buckle grooves are formed at the lower end of the flanges (2*f*) of the needle-supporting front cover plate (2) for engagement with the buckle bolts (2*s*') mounted on both side plates (1*a*) of the body (1). The needle-supporting front cover plate (2) is stably mounted and maintained in the forefront opening of the body (1) by said hinge pins (2*s*) and buckle bolts (2*s*').

Figure 1:
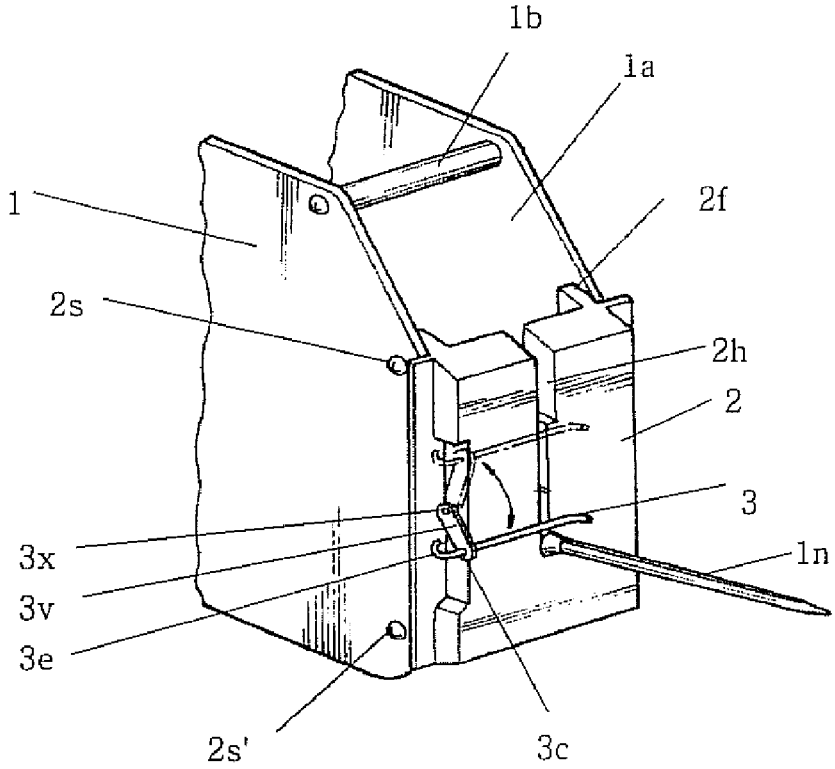
FIG. 1 is a perspective view of the apparatus for adjusting the length of a thread loop in a tag fastener in the present invention.
Figure 2:
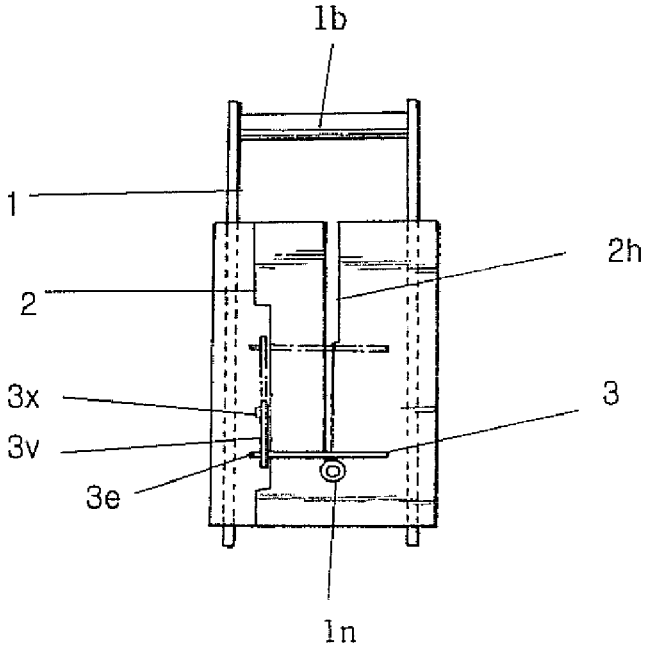
FIG. 2 is a front view of the apparatus in the present invention.
Figure 3:
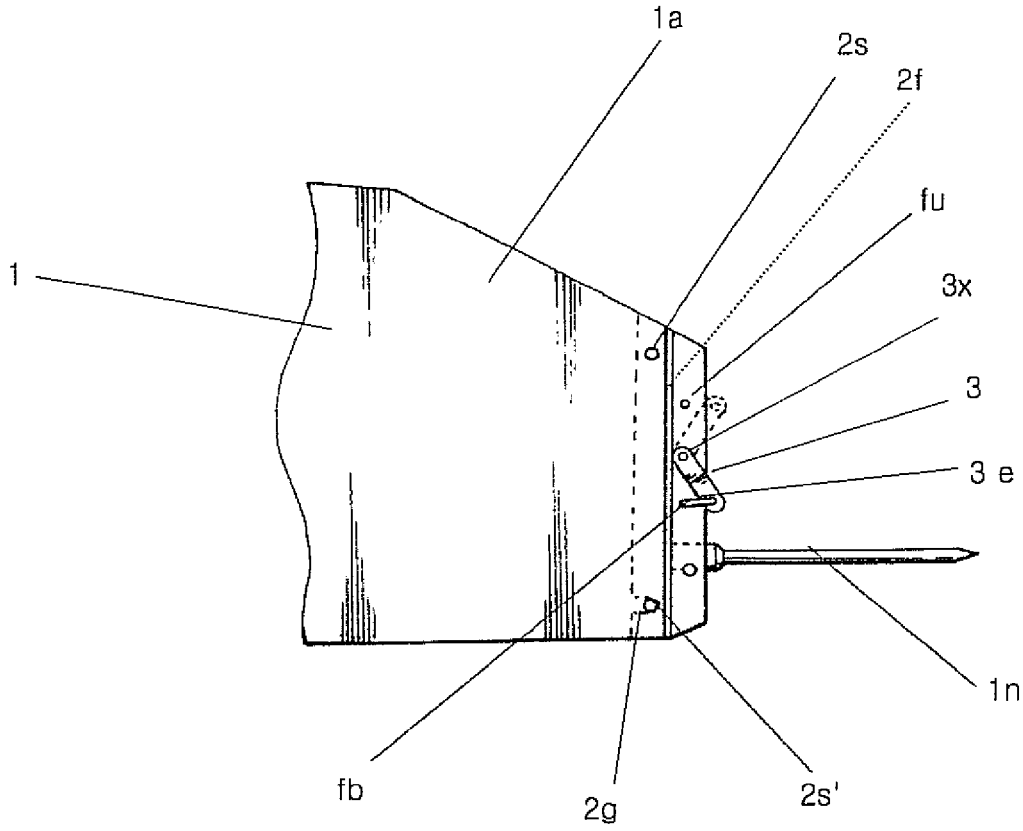
FIG. 3 is a side view of the apparatus in the present invention.

As shown also in FIG. 1 through FIG. 3, a displacement lever (3*v*) of a certain length is switchably mounted via a lever shaft (3*x*) on a side in the middle portion of the needle-supporting front cover plate (2); a thread hanging bar (3) is inserted into a hole (3*c*) formed on the outer end portion of the displacement lever (3*v*) and placed in such a way as to cross the slit (2*h*) of the needle-supporting front cover plate; and by optionally inserting the bended end (3*e*) of the thread hanging bar (3) into the upper stay hole (fu) or the bottom stay hole (fb) formed on a side of the needle-supporting front cover plate (2), the thread hanging bar (3) can be placed in an upper step position or in a lower step position.

In the drawings, the unexplained numerals are C for the knotter, D for the thread contactor, H for the hook, R for the thread supply rod, T for the tag, S for thread, and Q for the thread loop.

As the needle-supporting front cover plate (2) is mounted at the forefront portion of the body (1) in such a way as to be opened and closed, the flanges (2*f*) of the needle-supporting front cover plate (2) are inserted into the inner sides of the side plates (1*a*) of the body (1) and are supported by the hinge pins (2*s*) and buckle bolts (2') making it possible for the need-supporting front cover plate (2) to be mounted onto the body (1) safely and stably, and in fastening a tag (T) by piercing the needle (1*n*) through the product and the tag (T), the needle is firmly supported and does not shake thereby making the tagging work easy.

Figure 4:
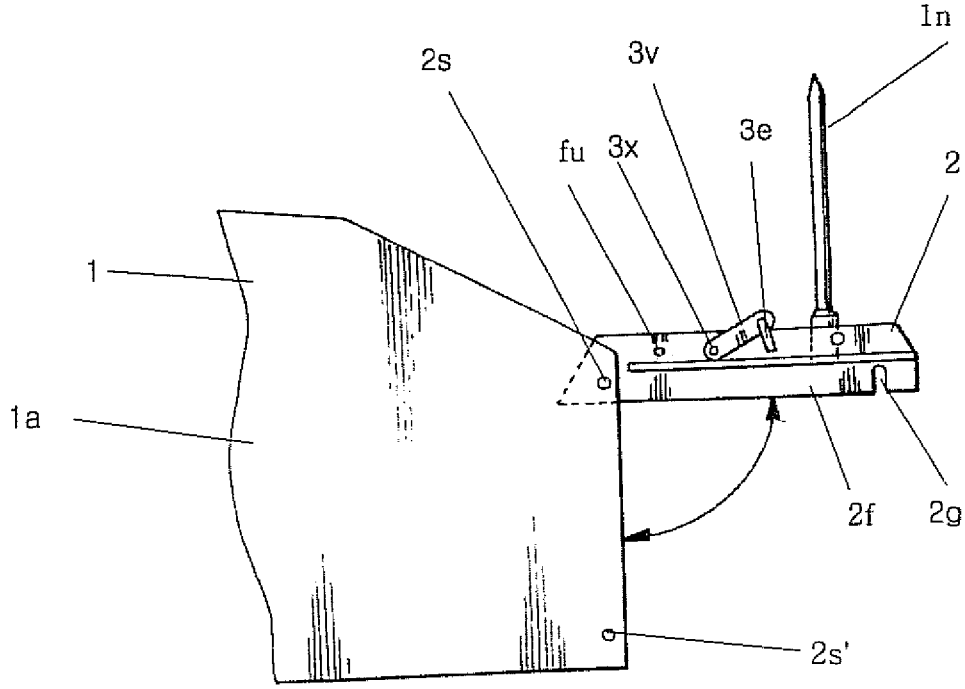
FIG. 4 is a side view of the apparatus in the present invention showing its front cover plate being opened.

Also, in cleaning the inside of the body, as shown in FIG. 4, if the needle-supporting front cover plate (2) is pulled upward, the needle-supporting front cover plate (2) is opened upwards with the hinge pins (2*s*) as a fulcrum. Therefore, the dust and waste threads sticking inside the body can be cleaned easily and conveniently through the opening in the front portion of the body that includes the waste thread releasing outlet, thereby preventing the complex mechanism of gears and other components in the body from malfunctioning due to dust and waste threads.

If a tag (T) is fastened with the thread hanging bar (3) being placed in a lower step position (shown in a full line in FIG. 1), the distance between the thread hanging bar (3) and the knotter (C) in the body gets shorter, forming a loop with its length commensurate with the distance between the thread hanging bar (3) and the knotter (C).

Figure 5:
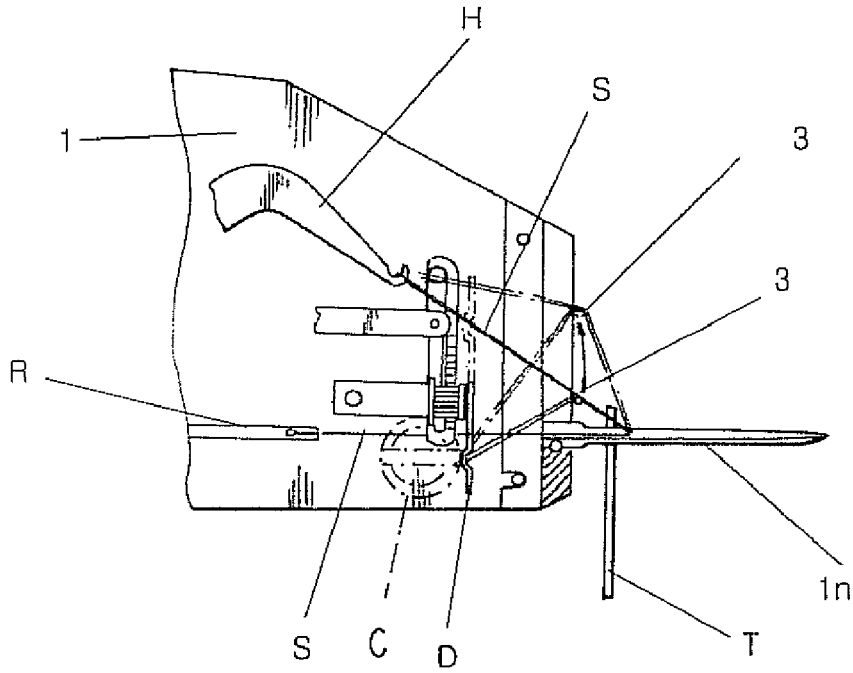
FIG. 5 is a side view of the apparatus in the present invention showing its loop length adjusting operation in fastening a tag.
Figure 6:
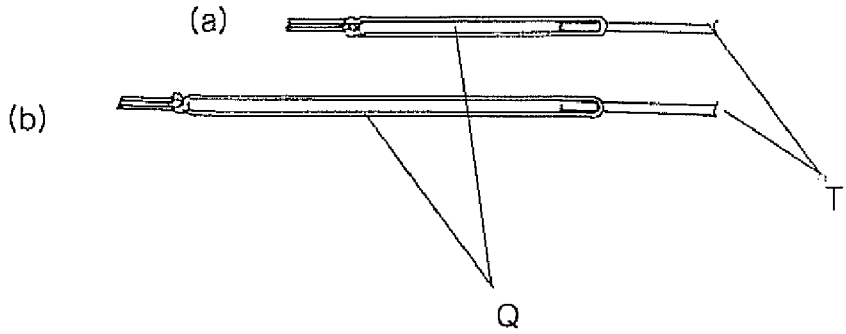
FIG. 6 shows an example of the loops of different lengths
Figure 7:
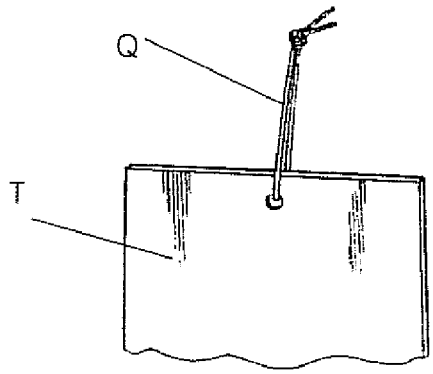
FIG. 7 shows an example of a loop formed on a tag.

In other words, as shown in FIG. 5, after piercing the needle (1*n*) of the tag fastener (1) through the product and the tag (T), if the lever (not shown in the drawing) of the tag fastener is pulled, the thread supply rod (R) moves forward by a mechanical operation along the groove in the needle (1*n*), and at this time, the hook (H) mounted in the body hooks up the thread (S) supplied to the needle (1*n*) and pulls the thread into the inside of the body through the slit (2*h*), and then the thread contactor (D) receives the thread hooked by the hook (H) and takes it to the knotter (C) (shown in a dotted line) mounted on the other side plate of the body. At this time, the thread (S) shown in FIG. 5 forms a triangular loop (shown in a full line) via the needle (1*n*)—thread hanging bar (3)—thread contactor (D) and reaching the knotter (C), and the known knotter (C) knots the loop (Q). At this time, the length of the loop (Q) fastened to the tag is commensurate with the lower step position of the thread hanging bar (3) as shown in FIG. 6(*a*).

Likewise, if a tag is fastened with the thread hanging bar (3) being at the upper step position, if the length of the displacement lever (3*v*) is 10 mm, the thread hanging bar (3) is placed by the displacement lever (3*v*) at a distance of 20 mm from the lower step position thereby increasing the distance between the thread hanging bar (3) and the knotter (C) leading to the formation of a loop in the form of a triangle (shown in a dotted line) with a longer hypotenuse from the needle (1*n*)—the thread hanging bar (3)—the thread contactor (D) and reaching the known knotter (C), and the knotter (C) knots the loop (Q). At this time, the length of the loop (Q) fastened to the tag is commensurate with the upper step position of the thread hanging bar (3) as shown in FIG. 6(*b*).

If the displacement lever (3*v*) of the thread hanging bar (3) is switched to the lower step or to the upper step position and the bended end (3*e*) of the thread hanging bar (3) is inserted into the upper stay hole (fu) or the bottom stay hole (fb) formed on a side of the needle-supporting front cover plate, the thread hanging bar is fixed in the upper step or the lower step position maintaining the position of the thread hanging bar (3) firmly thereby ensuring safety in the tag fastening work.

Moreover, as the means to vary the positions of the thread hanging bar is of such a simple construction, its production is easy, and as there is little likelihood of the components of the apparatus going out of order, the tag fastener can be used more conveniently varying the size of the thread loop for fastening a tag according to the needs.

In the present invention, as the needle-supporting front cover plate is mounted at the forefront portion of the body in such a way that the needle-supporting front cover plate can be opened upwards and closed downwards, the needle-supporting front cover plate may be opened for the cleaning of the inside of the body with ease, doing away with the inconvenience of cleaning it only through the waste thread releasing outlet in conventional tag fasteners.

Furthermore, as the thread hanging bar can be variably positioned at an upper step position or a lower step position by a displacement lever mounted on a side of the needle-supporting front cover plate, the length of the thread loop for fastening a tag may be selectively formed according to the upper or the lower step position of the thread hanging bar, making it possible to use the tag fastener more conveniently than in the case of the conventional tag fasteners.

What is claimed is:

1. An apparatus for adjusting a length of a thread loop in a tag fastener for fastening a tag by looping and knotting a thread, wherein a needle-supporting front cover plate is hingedly mounted onto an open forefront portion of a tag fastener body whereby said needle-supporting front cover plate is mounted onto the tag fastener body via hinge pins to be translatable between opened position and a closed position;

said apparatus further including a thread hanging bar for hanging a thread loop, said thread hanging bar being supported by a displacement lever mounted on a middle portion of the needle-supporting front cover plate.

2. An apparatus for adjusting a length of a thread loop in a tag fastener for fastening a tag by looping and knotting a thread as claimed in claim 1, wherein the thread hanging bar is positioned transversely across a slit in the needle-supporting front cover plate;

further wherein the thread hanging bar is translatable between an upper step position and a lower step position.

3. An apparatus for adjusting a length of a thread loop in a tag fastener as claimed in claim 1, wherein hinge pins are mounted through the tag fastener body side plates into an upper end portion of inserting flanges formed in an inner portion of the needle-supporting rectangular front cover plate;

further wherein the inserting flanges are adapted for inserting into the open forefront portion of the body between first and second side plates of the tag fastener body.

4. An apparatus for adjusting a length of a thread loop in a tag fastener as claimed in claim 3, further including buckle grooves formed in the lower end sides of the inserting flanges for engaging cooperating buckle bolts mounted on the tag fastener body side plates.

5. An apparatus for adjusting a length of a thread loop in a tag fastener as claimed in claim 2, wherein a portion of the thread hanging bar is passed through a hole in an upper end portion of the displacement lever translatably mounted via a lever-shaft;

further wherein an end of the thread hanging bar is adapted for insertion into an upper stay hole or into a bottom stay hole formed on a side of the needle-supporting front cover plate, whereby the thread hanging bar may be removably retained in one of an upper step position and a lower step position.

* * * * *